US007579532B2

(12) United States Patent
Shelton

(10) Patent No.: US 7,579,532 B2
(45) Date of Patent: Aug. 25, 2009

(54) STRING MUSICAL INSTRUMENT

(76) Inventor: John E. Shelton, 8469 N. 46th St., Brown Deer, WI (US) 53223

( * ) Notice: Subject to any disclaimer, the term of this patent is extended or adjusted under 35 U.S.C. 154(b) by 18 days.

(21) Appl. No.: 11/952,107

(22) Filed: Dec. 6, 2007

(65) Prior Publication Data

US 2008/0134859 A1 Jun. 12, 2008

Related U.S. Application Data

(60) Provisional application No. 60/869,663, filed on Dec. 12, 2006.

(51) Int. Cl.
*G10D 1/08* (2006.01)

(52) U.S. Cl. ..... 84/267

(58) Field of Classification Search ..... 84/267, 84/293, 291

See application file for complete search history.

(56) References Cited

U.S. PATENT DOCUMENTS

| | | | | |
|---|---|---|---|---|
| 4,245,540 | A | 1/1981 | Groupp | |
| 5,932,827 | A | 8/1999 | Osborne | |
| 6,320,113 | B1 | 11/2001 | Griffin | |
| 6,563,033 | B1 | 5/2003 | Porzilli | |
| 6,800,797 | B2 | 10/2004 | Steiger | |
| 2003/0094087 | A1 * | 5/2003 | Gregory | 84/267 |

* cited by examiner

*Primary Examiner*—Kimberly R Lockett

(57) ABSTRACT

A stringed musical instrument which includes a main instrument body, a fretted neck affixed to said instrument body, a headstock affixed to said fretted neck, a fifth string having a gauge of 0.060 to 0.068 inches, a fourth string having a gauge of 0.038 to 0.048 inches, a third string having a gauge of 0.022 to 0.032 inches, a second string having a gauge of 0.009 to 0.014 inches and a first string having a gauge of 0.22 to 0.032 inches.

20 Claims, 3 Drawing Sheets

STRING MUSICAL INSTRUMENT

CROSS-REFERENCE TO RELATED APPLICATION

This application claims the benefit of and priority to U.S. provisional application Ser. No. 60/869,663, filed on 12 Dec. 2006 and incorporated herein in its entirety.

FIELD OF THE INVENTION

This invention relates generally to the field stringed musical Instruments, and more specifically to versatile stringed instruments having modified characteristics of a bass guitar, guitar and dulcimer capable of producing a unique sound.

GLOSSARY

Figure 1:
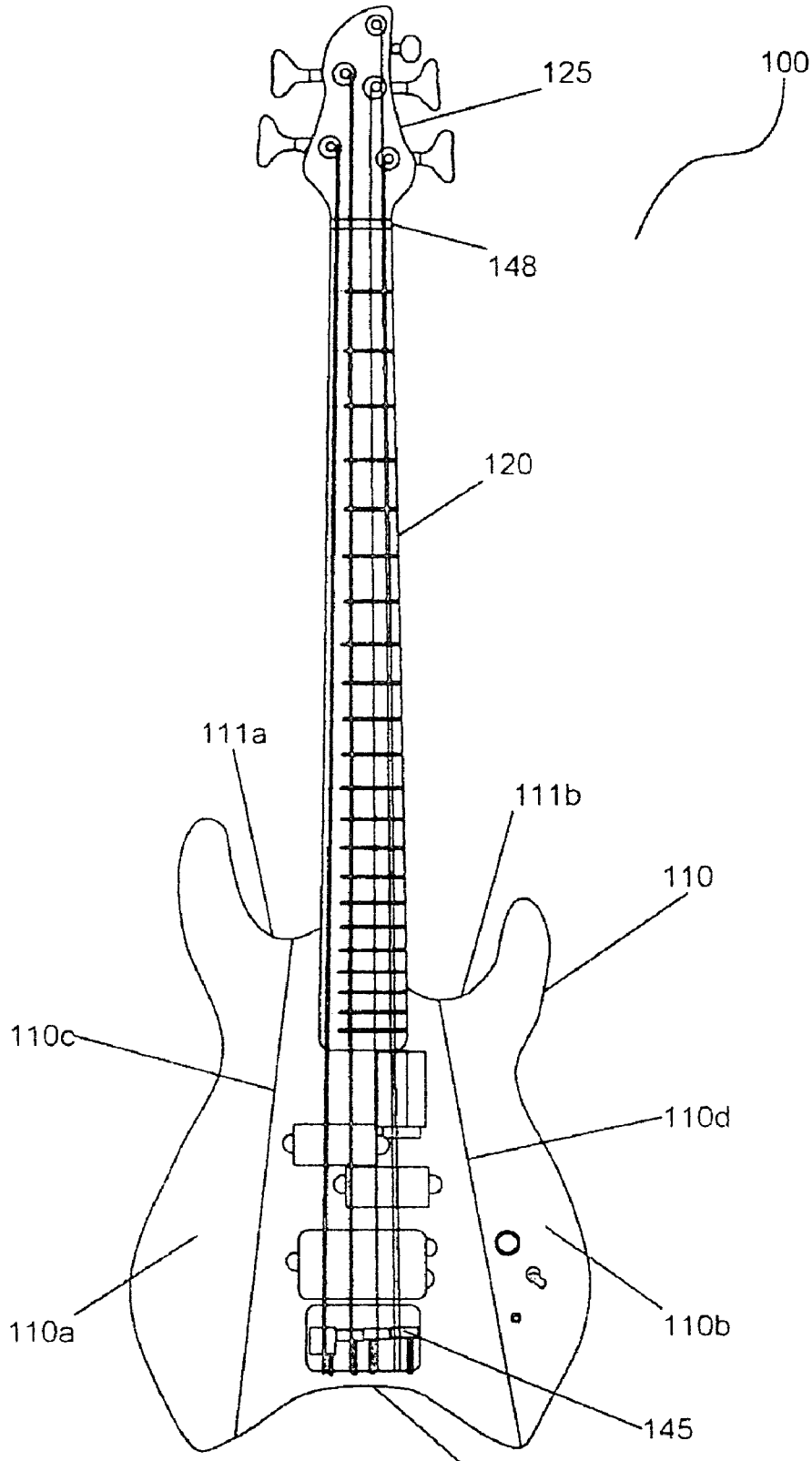
FIG. 1 is a front view of one embodiment of a Bassimer™.

The following glossary is a partial list of terms used by one skilled in the musical art.

As used herein, the term "bass guitar" means an acoustic or electrically powered guitar which normally produces pitches within a lower range of frequency than a standard guitar.

As used herein, the term "course" means adjacent strings tuned to an octave and usually plucked together as if a single string.

As used herein, the term "drone" means a harmonic or monophonic effect or accompaniment where a note or chord is continuously sounded throughout much or all of a piece, sustained or repeated, and most often establishing a tonality upon which the rest of the piece is built.

As used herein, the term "dulcimer" means a fretted string instrument typically with three or four strings, but which may have as many as twelve strings and six courses.

As used herein, the term "fret" means thin metal strip used on several a stringed musical instrument which assists the musician who is playing the instrument to produce a particular pitch.

As used herein, the term "gauge" means a particular diameter or thickness of a string, generally expressed in inches. On a stringed instrument, the gauge is selected to produce a range of pitches. A thicker gauge generally produces a lower pitch, while a thinner gauge generally produces a higher pitch.

As used herein, the term "guitar" means a fretted string instrument typically with six or twelve strings each that can be tuned to various pitches, each string made or wire, nylon or other materials having varying thicknesses or gauges suited to produce a particular pitch or range of pitches.

As used herein the term "octave" means the pitch interval between one musical note and another with half or double its frequency.

As used herein, the term "pickup" device means a device that captures mechanical vibrations from stringed instruments and converts them to an electrical signal which can be amplified and recorded.

As used herein, the term "piezo pick-up" device means a pickup device that has a higher output impedance than a standard pickup, and has an advantage of not picking up as many unwanted magnetic fields, such as noise from power sources and feedback from monitoring loops.

As used herein the term "pitch" or "note" is the perceived fundamental frequency of a sound.

As used herein, the term "resonating device" or "sustaining device" means a device that generates a magnetic reaction to vibrate the strings of a guitar to simulate the bow of a violin. One commercially available type of resonating device is an Ebow™ which is a brand name for a hand-held device for playing the electric guitar, which creates an electromagnetic field which moves the strings to produces a sound reminiscent of using a bow on the strings.

As used herein, the term "unfretted string" means a string which does not have a fret positioned beneath it so as to allow the player of the musical instrument greater control over variations in pitch.

BACKGROUND

Approximately 700,000 people in the United States play either an electric or acoustic version of the guitar. It is one of the five most popular instruments in the United States, and there is an extensive market for guitar accessories and variations. Many guitar enthusiasts own multiple instruments because each of type of instrument has a distinctive type of sound, and physical qualities which affect the playing experience. The components of a guitar which produce its sound are strings of varying gauges, frets, tuning keys and the shape and size of the neck and body. A guitar is often used for solo performances, because it can produce many notes and harmonies. A guitar is typically played by holding it in an upright position against the body.

One variation of a guitar is a bass guitar, which is specifically configured to produce lower pitches. A bass guitar typically has strings of heavier gauges and which are longer in length. A bass is usually played in bands and it less common to see a solo performance by a bass guitarist. The bass guitar produces fewer notes and harmonies, and generally complements other instruments in a performance setting. A bass guitar, like a standard guitar, is typically played by holding it in an upright position against the body.

A dulcimer is a traditional American folk instrument which is played while holding the instrument on the lap or placing it on a substantially flat surface, and plucking or strumming the strings with one hand, while moving the other hand along the frets of the instrument.

A dulcimer typically produces a characteristic sound known as "drone" where a note or chord is continuously sounded throughout much or all of a piece. Although it is technically possible to produce a drone on a guitar, it not desirable to do so because tuning the guitar to do so is cumbersome and effectively eliminates the ability of the guitarist to perform many standard chord configurations.

Another device known to those skilled in the musical arts is a hand-held resonating or "sustaining" device which may be used to produce a variety of sounds not usually playable on an electric guitar. The sounds may stimulate the bow of a violin. One such commonly known commercially available device is the EBow™ which is described in U.S. Pat. No. 4,852,444. By varying the EBow's position on a string, the player can produce different string overtones and can also gain an additional octave pitch known as "harmonic mode," which produce a higher sound instead of the fundamental note. However, it is difficult to control a resonating device in relation to a particular string because it is a separately held device.

Permanently mounted sustaining devices have traditionally interacted with all, rather than select, strings.

EXEMPLARY ATTRIBUTES OF INVENTION

It is desirable to have an instrument which combines features of a bass guitar, dulcimer, and guitar and which produces a wide range of tones with a drone quality to fill the sound space without interfering with the melody lines.

It is further desirable to have an instrument on which the spacing of the strings allows aggressive slap playing styles while maintaining comfortable guitar finger-style, tap and strumming distances.

It is further desirable to have an instrument which combines string diameters, string length, octave string features and course features to produce enhanced harmonic and subharmonic frequencies at audible volume levels.

It is further desirable to have a physically versatile instrument which can be played as a lap instrument, similar to a dulcimer or held toward the body in a position similar a standard guitar or a bass guitar.

It is intended that any other advantages and objects of the present invention that become apparent or obvious from the detailed description or illustrations contained herein are within the scope of the present invention.

DESCRIPTION OF EMBODIMENTS OF THE INVENTION

For the purpose of promoting an understanding of the present invention, references are made in the text hereof to a stringed instrument and a method of making same, only some of which are depicted in the figures. It should nevertheless be understood that no limitations on the scope of the invention are thereby intended. One of ordinary skill in the art will readily appreciate that modifications such as the dimensions, size, shape, and materials (e.g., wood, plastics, or other synthetic or composite materials) are deemed readily apparent and obvious to one of ordinary skill in the art, and all equivalent relationships to those illustrated in the drawings and described in the written description do not depart from the spirit and scope of the present invention. Some of these possible modifications are mentioned in the following description. Therefore, specific details disclosed herein are not to be interpreted as limiting, but rather as a basis for the claims and as a representative basis for teaching one of ordinary skill in the art to employ the present invention in virtually any appropriately detailed apparatus or manner.

It should be understood that the drawings are not necessarily to scale, emphasis instead being placed upon illustrating the principles of the invention. In addition, in the embodiments depicted herein, like reference numerals in the various drawings refer to identical or near identical structural elements.

FIG. 1 illustrates a front view of one exemplary embodiment of Bassimer™ 100. The embodiment shown includes main instrument body 110, a fretted neck 120, and a headstock 125 which are fixably attached to each other in a method and manner which is typical of a standard guitar, dulcimer or bass guitar.

In the embodiment shown, main instrument body 110 has gentle curves to accommodate a number of playing positions, and includes cutouts 111*a* and 111*b* in the curvature of the body which accommodate access to all frets along fretted neck 120.

Also apparent in FIG. 1, in the exemplary embodiment shown, is bottom cutout 111*c* which expands the functionality of Bassimer™ 100 by accommodating a wide variance of playing positions, and which allows Bassimer™ 100 to stand upright on a floor or other surface without any support, such as a brace or surface on which to lean the instrument.

The embodiment shown further includes downward contours 110 *a* and 110*b*, which cause the outer sides of the upper surface of instrument body surface 110 to angle downward along contour lines 110*c* and 110*d*. This reduces the overall weight of the instrument, and creates ergonomically tapered edges which are more comfortable when resting against the body. Other embodiments may have varied contours to achieve the same function, or may omit such contours entirely.

Other embodiments of Bassimer™ 100 may have an a hollow body typical of an acoustic guitar, may exhibit version, "Dreadnaught" acoustic guitar shape known in the art, or the shape of any acoustic or electric guitar known in the art. This variance in the shape of instrument body 110 may facilitate differences in sound projection or may be solely aesthetic.

As also illustrated in FIG. 1, Bassimer™ 100, the embodiment shown typically has a 27 to 32 inch scale length, which signifies the overall distance from the point of contact between the bridge 145 and nut 148.

Figure 2:
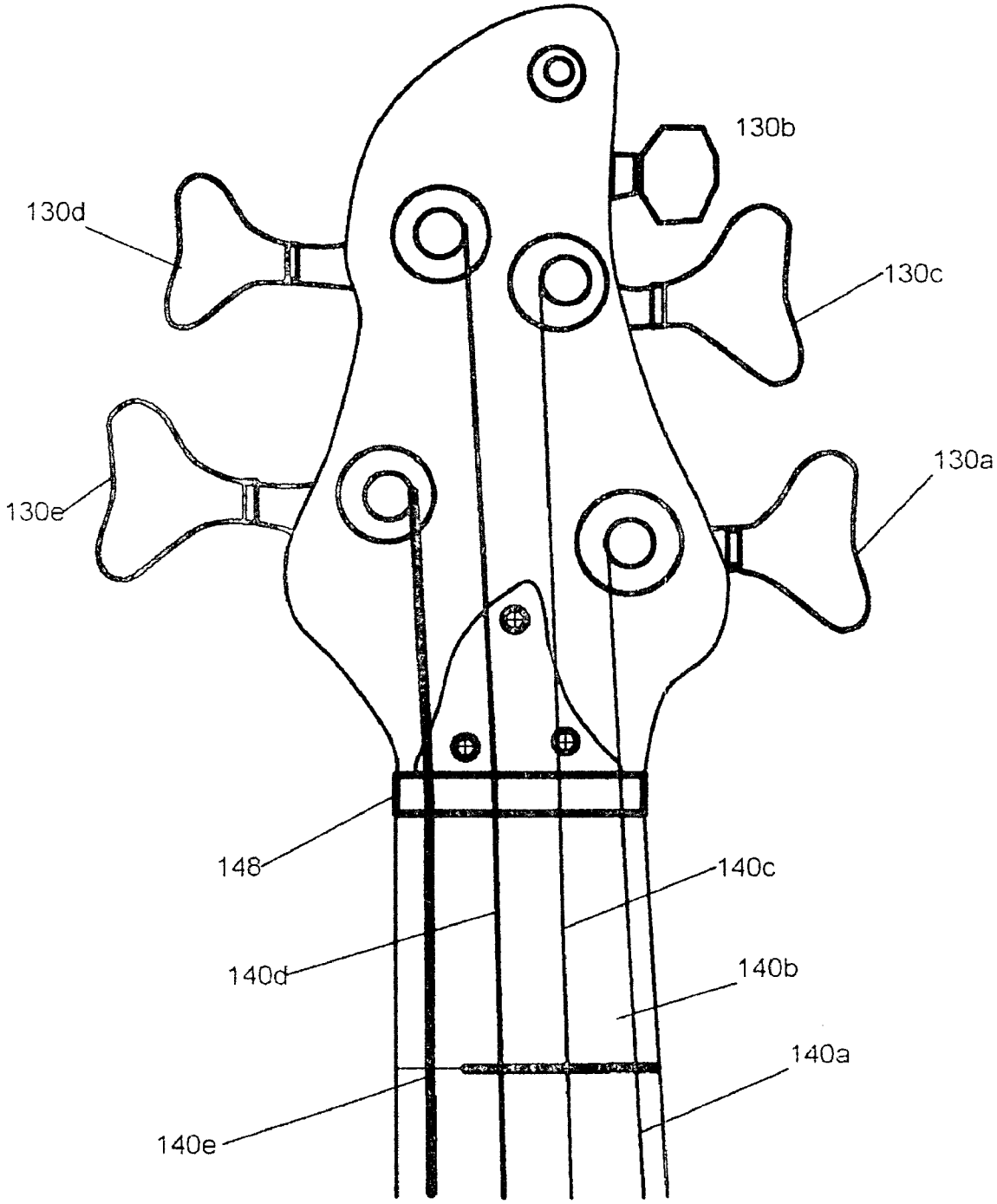
FIG. 2 is a partial view of the headstock and nut region of one embodiment of a Bassimer™ illustrating the string, fret and tuner configuration.

FIG. 2 illustrates a partial view of the headstock and nut region of one embodiment of a Bassimer™ illustrating the string, fret and tuner configuration.

The embodiment shown includes the five strings: fifth string 140*e*, fourth string 140*d*, third string 140*c*, second string 140*b* and first string 140*a*. The strings are of varying gauges as shown in the following table:

| String | Gauge (shown in inches) |
|---|---|
| Fifth | .060" to .068" |
| Fourth | .038" to .048" |
| Third | .022" to .032" |
| Second | .009 to .014" |
| First | .022" to .032" |

The embodiment shown includes fifth string 140*e*, fourth string 140*d*, third string 140*c*, and first string 140*a*. Fifth string 140*e*, fourth string 140*d*, third string 140*c*, and first string 140*a* are spaced equally across the face of fretted neck 120 being relationally positioned similarly to the positioning typically found on a bass guitar.

In the embodiment shown second string 140*b* is at a distance from string 140*a* having a ration of 23-27% of the distance between the fourth string 140*a* and third string 140*c*. Grooves in nut 148 and bridge 145 accommodate the foregoing configuration of strings.

In the embodiment shown fifth string 140*e* is an unfretted string which allows the player of the musical instrument greater control over variations in pitch.

As also illustrated in FIG. 2, fifth tuning key 130*e*, fourth tuning key 130*d*, third tuning key 130*c*, first tuning key 130*a* are of a size and type to accommodate the heavier gauges for strings 140*e*, 140*d*, 140*c* and 140*a* in the range of 0.022 to 0.068 inches. Second tuning key 130*b* is a tuner, appropriate for lighter gauge second string 140*b* having a gauge in the range of 0.009 to 0.014 inches.

In the embodiment shown Bassimer™ 100 has four strings, typically tuned to the same note at different octaves and one string tuned to a different pitch.

A typical tuning of the instrument would be to the notes would be (octaves of D and A) D, A, D2, D3/D2, but can be any tuning desired by one skilled in the art to achieve a desired musical effect.

Other embodiments of Bassimer™ 100 may use a variety of different signal pick-ups, tuner keys, and or string types and gauges.

Figure 3:
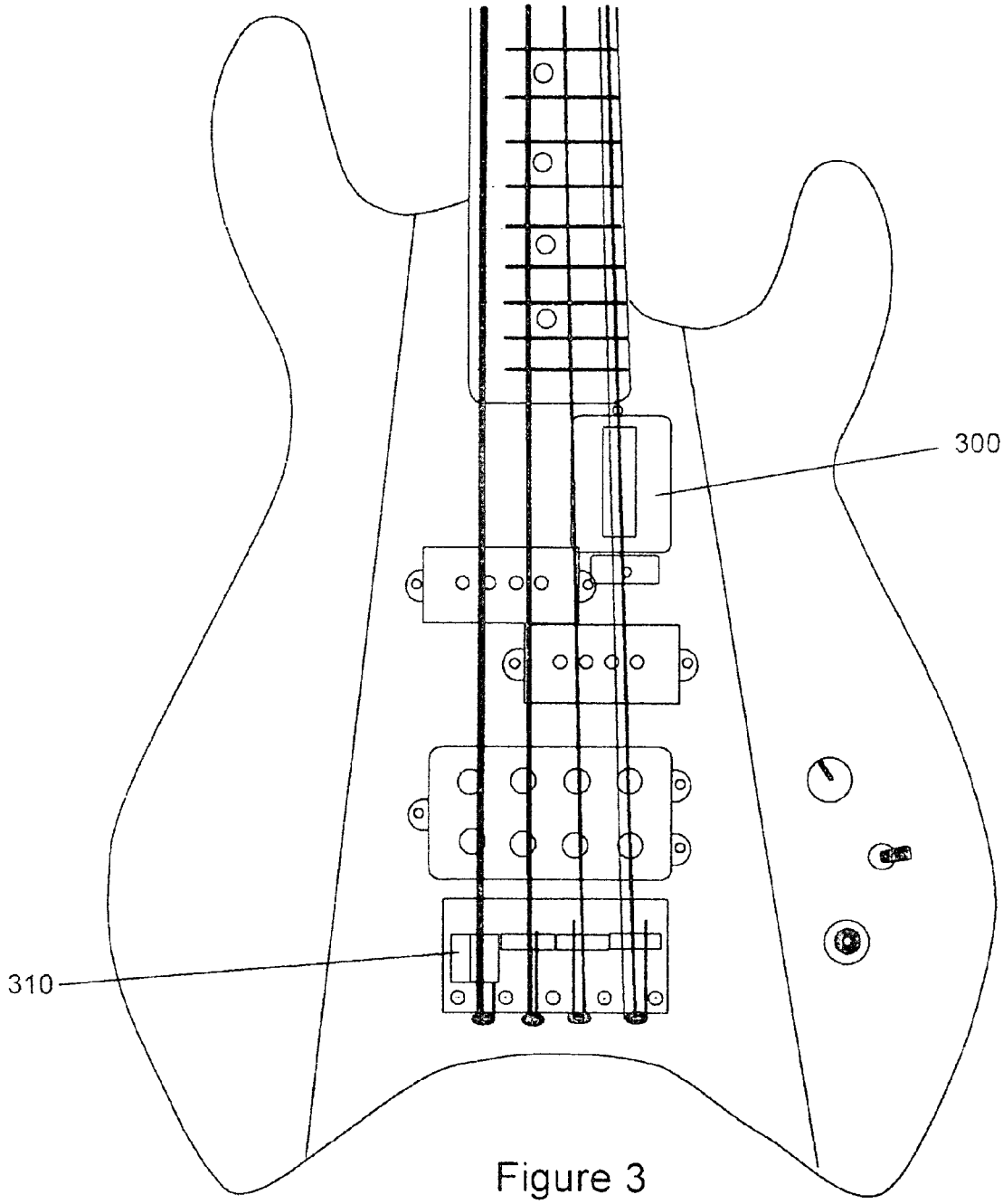
FIG. 3 is a partial view of a Bassimer™ illustrating the string configuration and a permanently mounted resonating device.

FIG. 3 illustrates is a partial view of a Bassimer™ 100 which further includes permanently mounted resonating device 300. Resonating devices are commonly known in the art, and one popular version of such a device is sold under the Ebow™ name.

In the embodiment shown, resonating device 300 is permanently affixed or mounted beneath strings 140*a* and 140*b*. In other embodiments, resonating device 300 may be mounted beneath 140*c*, 140*d*, or 140*e* or beneath any other combination of strings.

The vibrations from the strings can be picked up using standard guitar or bass electro-magnetic pick-up device, a piezo pickup or any device which converts vibrations to electronic signals known in the art.

The exemplary embodiment shown, piezo device 310 is used on fifth string 140*e* as pick-up device, which emphasizes a distinctive sound quality of fifth string 140*e*.

Other embodiments of Bassimer™ may include a guitar synthesizer and any pickup configuration to achieve a desired effect using the guitar synthesizer (not shown).

What is claimed is:

1. A stringed musical instrument comprised of:

a main instrument body wherein said fifth string, said fourth string, said third string and said first string are equally spaced, and wherein said second string is spaced at a distance of 23-27% of the distance between said first and said third string, and said second string is closer to said first string than to said third string;

a fretted neck affixed to said instrument body;

a headstock affixed to said fretted neck;

a fifth string having a gauge of 0.060 to 0.068 inches;

a fourth string having a gauge of 0.038 to 0.048 inches;

a third string having a gauge of 0.022 to 0.032 inches;

a second string having a gauge of 0.009 to 0.014 inches;

a first string having a gauge of 0.22 to 0.032 inches; and at least one course.

2. The stringed instrument of claim 1, wherein at least one string is unfretted.

3. The stringed instrument of claim 1, wherein said fifth string is unfretted.

4. The stringed instrument of claim 1, which further includes a piezo pickup device which captures vibrations from at least one string.

5. The stringed instrument of claim 1, which further includes a piezo pickup, device which captures vibrations from said fifth string.

6. The stringed instrument of claim 1, which further includes a piezo pickup device which captures vibrations from said unfretted fifth string.

7. The stringed instrument of claim 1, which further includes a permanently affixed resonating device.

8. The stringed instrument of claim 1 which further includes a permanently affixed resonating device beneath said first string and said second string.

9. The stringed instrument of claim 1 which further includes a small tuning key affixed to the lower side of the headstock to accommodate the placement of said second string.

10. The stringed instrument of claim 1 which further includes a bottom cutout which allows said stringed instrument to stand upright without support.

11. The stringed instrument of claim 1 which further includes contouring of the upper surface and lower surfaces to reduce the weight of said stringed instrument (not clear how this was amended).

12. A method of constructing a stringed musical instrument comprised of:

adapting the fretted neck, nut and the headstock of a bass guitar to accommodate a fifth string having a gauge of 0.060 to 0.068 inches, a fourth string having a gauge of 0.038 to 0.048 inches, a third string having a gauge of 0.022 to 0.032 inches, a second string having a gauge of 0.009 to 0.014 inches, and a first string having a gauge of 0.22 to 0.032 inches wherein said fifth string, said fourth string, said third string and said first string are equally spaced, and wherein said second string is spaced at a distance of 23-27% of the distance between said first and said third string, and said second string is closer to said first string than to said third string, spacing said fifth string, said fourth string, said third string and said first string at an equal distance wherein said second string is spaced at a distance of 23-27% of the distance between said first and said third string, and said second string is closer to said first string than to said third string installing a small tuning key in the lower portion of said headstock to accommodate the placement of said second string.

13. The method of claim 12 which further includes adapting the neck of said bass guitar to create at least one unfretted string.

14. The method of claim 12 which further includes installing a piezo pickup device which captures vibrations from at least one string.

15. The method of claim 12 which further includes installing a piezo pickup device which captures vibrations from said fifth string.

16. The method of claim 12 which further includes installing a piezo pickup device which captures vibrations from said unfretted fifth string.

17. The method of claim 12 which further includes installing a small tuning key affixed to the lower side of the headstock to accommodate the placement of said second string.

18. The method of claim 12 which further includes installing a permanently affixed resonating device to said stringed instrument.

19. The method of claim 12 which further includes carving a bottom cutout in the base of said stringed instrument which allows said stringed instrument to stand upright without support.

20. The method of claim 12 which further includes contouring of the upper surface and lower surfaces to reduce the weight of said stringed instrument.

* * * * *